United States Patent [19]

Schipman

[11] 4,117,777

[45] Oct. 3, 1978

[54] REFUSE CONTAINER, AND REFUSE COMPACTING AND DISCHARGING DEVICE THEREFOR

[76] Inventor: Jean-Marie Schipman, 170, rue Saint Charles, Paris, France, 75015

[21] Appl. No.: 802,529

[22] Filed: Jun. 1, 1977

[30] Foreign Application Priority Data

Jun. 3, 1976 [FR] France ..... 76 16788
Nov. 30, 1976 [FR] France ..... 76 36011

[51] Int. Cl.[2] ..... B30B 15/30

[52] U.S. Cl. ..... 100/215; 100/229 A; 100/290; 193/34; 232/44

[58] Field of Search ..... 100/49, 215, 290, 229 A; 220/65; 214/35 R; 141/316, 390; 53/124 B; 302/27; 193/33, 34; 232/44; 49/68

[56] References Cited

U.S. PATENT DOCUMENTS

| | | | |
|---|---|---|---|
| 1,530,787 | 3/1925 | Oberst | 193/34 |
| 2,480,685 | 8/1949 | Adams | 232/44 |
| 2,885,975 | 5/1959 | Campbell | 193/33 |
| 3,357,346 | 12/1967 | Crafoord | 100/229 A |
| 3,727,546 | 4/1973 | McKinney | 100/229 A |
| 3,754,501 | 8/1973 | Horn | 100/229 A |
| 3,793,944 | 2/1974 | Grubich | 100/229 A |
| 3,949,663 | 4/1976 | Eckerle | 100/229 A |

*Primary Examiner*—Billy J. Wilhite
*Attorney, Agent, or Firm*—Wenderoth, Lind & Ponack

[57] ABSTRACT

A bottomless container for household dry refuse such as garbage and rubbish is positioned within a bag having its upper edge folded firstly inwardly and then outwardly of the container edge, so that the refuse can be compacted and the bag removed when the bottomless container is raised off the bag. The system for filling the container comprises a box-shaped trap pivotally mounted to an external wall of the house, at the bottom of an aperture adapted to be closed by a double seal device operatively connected to the trap, so that when the trap is shut the aperture is closed by the bottom of the trap and by one of a pair of parallel vertical spaced curtains of the double seal device, and when the trap is open the aperture is closed by the pair of curtains. The aperture leads into a rubbish chute which receives the container in its bottom and which has means in its upper portion for compacting the refuse.

9 Claims, 10 Drawing Figures

REFUSE CONTAINER, AND REFUSE COMPACTING AND DISCHARGING DEVICE THEREFOR

BACKGROUND OF THE INVENTION

The present invention relates in general to solid waste or like refuse disposal and has specific reference to an improved container adapted to collect dry or town refuse (garbage) or rubbish, preliminary to compacting and subsequently discharging this solid waste in a compacted condition.

Hitherto known refuse containers, designed for use either as such or in conjunction with compacting systems, comprise as a rule a bag of any suitable material for lining completely the inner lateral walls and bottom of the container.

These known containers are objectionable mainly in that the removal of the internal bag requires the extraction thereof from the container. Now, in most instances, due to the specific nature of the refuse, rubbish and waste, and also nearly compulsorily when such refuse is compacted, this lining bag is generally torn, thus forming apertures through which a relatively large amount of waste and refuse can escape. As a result, this refuse disposal method is attended by tedious and polluting consequences.

SUMMARY OF THE INVENTION

It is the primary object of the present invention to provide a refuse container designed with a view to avoid completely the inconveniences characterizing hitherto known containers.

The refuse container according to this invention is characterized essentially in that it is bottomless and that the bag associated therewith is disposed externally of the container, instead of lining the inner space of the container.

With the present invention, the pressure and chafing caused by the fall of garbage and waste, and especially when a compacting action is applied thereto, are exerted not on the bag proper but on the container consisting as a rule of a material much stronger than the bag material. Therefore, the bag is not likely to be damaged and its removal through the open bottom of the container is greatly facilitated.

Of course, the refuse container according to this invention may be used alone. However, it may also advantageously be used in a system for collecting storing, compacting and discharging refuse in small houses such as villas and the like, a system of this type being also an integral part of the present invention.

This refuse collecting storing, compacting and discharge system, which comprises on the one hand as a rule a box-shaped trap disposed in a dwelling room, mainly a kitchen or a nearby closet, the box-shaped trap being usually hingedly mounted to the wall of a rubbish chute, and on the other hand a compacting and discharge device to which the refuse and waste from the box-shaped trap are directed, mainly by gravity, is characterized essentially in that this refuse collecting compacting and discharge device is fitted in an outer wall of the house and separated from the inner rooms thereof by an insulating partition consisting advantageously of a preferably metal casing, framing or shaft having hollow walls filled with insulating material.

BRIEF DESCRIPTION OF THE DRAWINGS

A typical embodiment of this invention will now be described by way of example with reference to the attached drawings, it being understood however that other proportions, shapes and arrangements may be used in actual practice without departing from the basic principles of the invention. In the drawings.

DETAILED DESCRIPTION OF THE INVENTION

Figure 1:
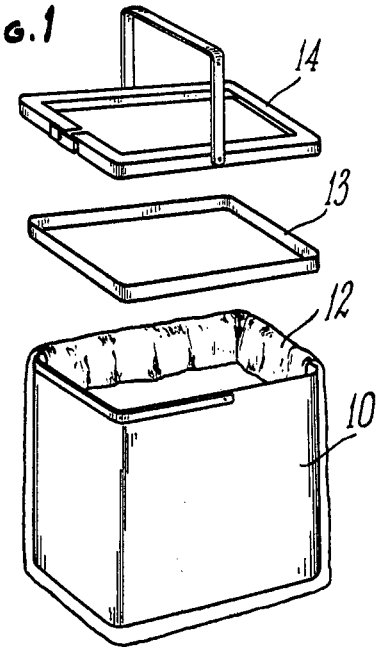
FIG. 1 is a perspective view showing the various elements of a refuse container according to this invention.
Figure 2:
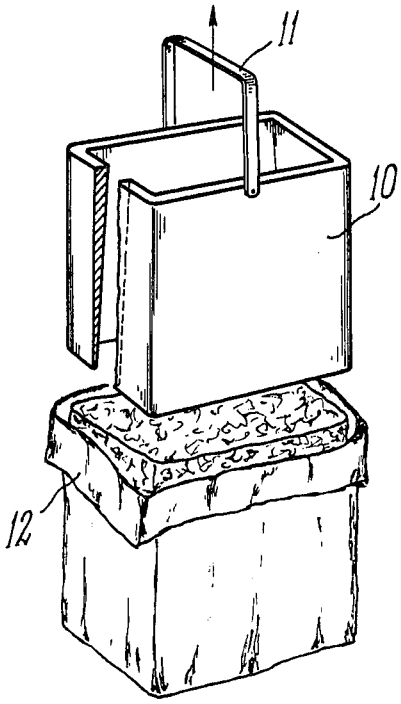
FIG. 2 is a view similar to FIG. 1, with parts broken away, showing the elements of the container after their separation for removing a refuse-containing bag.
Figure 7:
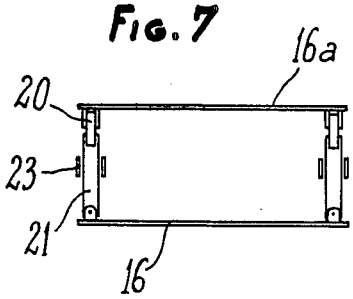
FIG. 7 is a plan view from above of this system.

As illustrated in FIGS. 1 and 2 of the attached drawings, the assembly according to this invention for collecting garbage, rubbish and waste comprises a bottomless container 10 provided with a handle 11 and associated with a bag 12 which, according to an essential feature of this invention, is disposed externally instead of internally of the container, in contrast to hitherto known inner lining bags.

The edge of bag 12 is firstly folded inwardly over the top edge of the container 10 and is then held thereon by a bag holding frame or ring 13, which may if desired be made of channel-shaped members. Then the bag edge is folded outwardly and is held in this position by a clamping frame or collar 14. However, any other suitable means may be used in lieu of the system described and illustrated herein for achieving the same purposes.

With the arrangement contemplated in the present invention, since the bag (of any suitable material, such as plastic) is disposed externally instead of internally of the container, any pressure and chafing likely to be exerted by the garbage and waste are applied to the wall of the container, instead of to the bag itself, so that the bag will not be damaged.

To discharge the refuse, whether in a compacted or non-compacted condition, and in contrast to the conventional procedure, the present invention contemplates the removal of the container from the garbage-filled bag without having to handle the latter, and this constitutes an essential and very important feature of the present invention.

In fact, it is only necessary to remove the means holding the bag on the container for eventually detaching the bag from the container, by simply lifting the latter off the bag, that is, by pulling upwardly on the handle 11 fitted to the container.

Since the container 10 is bottomless, it can be extracted very easily from the plastic bag 12 and the latter will remain undamaged on the bottom of the rubbish chute. However, the assembly and bag can be transported without any inconvenience for depositing the bag at a desired location.

The shape of container 10 is immaterial. Thus, a parallelipipedic shape may be contemplated, as in the example illustrated, but the shape of a body of revolution such as cylindrical, frustoconical, etc. may also be used. To facilitate the discharge of refuse, the container has preferably an internal taper, and as illustrated in FIG. 2 the inner dimensions of its lower base are greater than the inner dimensions of its upper base.

The container according to this invention may advantageously be used in a system for rubbish chute collecting, storing, compacting and discharging garbage or waste in small houses and villas, and such system will now be described in detail with reference to FIGS. 3 to 10 of the attached drawings.

This system, as illustrated notably in FIG. 3, comprises a rubbish chute box-shaped trap A which is fitted to the kitchen wall of a building and which comprises a drawer-like, hingedly-mounted trap 15, a compacting device B associated with an assembly C comprising in turn a container 10 as described hereinabove and acting as a receptacle for the garbage. Compacting device B and assembly C are disposed outside the house or within the wall. Garbage may be supplied through an aperture D into the assembly C.

According to the illustrated embodiment of this invention, the compacting device B and the garbage collecting assembly C are arranged within an external wall 1 of the house and are separated from the inner room or kitchen of the house by a sealing, insulating partition E of adequate thickness, consisting of a metal casing, framing or shaft having its hollow walls filled with insulating material such as low-density plastic material, for example polystyrene. This fluid-tight partition E has a twofold purpose, i.e. on the one hand, it insulates the compacting mechanism and the receptacle, so that no bad smell can penetrate into the kitchen, and on the other hand it acts as an efficient heat and sound insulating protection.

The aperture D for delivering the garbage collected in the box-shaped trap 15 to the compacting device B is formed through the partition E, and the trap 15 hingedly mounted to the inner surface of partition E.

According to a specific feature characterizing this invention, the aperture D is constantly closed by a double seal closing arrangement, except, of course, when garbage is being discharged therethrough.

This double seal closing arrangement comprises a pair of parallel spaced vertical curtains 16 and **16*a* when the box-shaped trap 15 is tilted down to its open position for receiving rubbish or refuse, and the rear or inner curtain 16*a* and the bottom 15*a* of box-shaped trap 15** when the trap is closed.

In the exemplary embodiment illustrated, the front curtain 16 and the trap 15 are operatively connected by linkage including links 17 and **17*a***.

During its pivoting movement the trap 15 carries along the front curtain 16 by means of links 17 and **17*a* which are fulcrumed to a common pivot pin 18. An assembly including links 17, 17*a* and pivot pin 18 are disposed on either side of the device and driven by means of a respective pair of meshing pinions 19, 19*a***.

Figure 3:
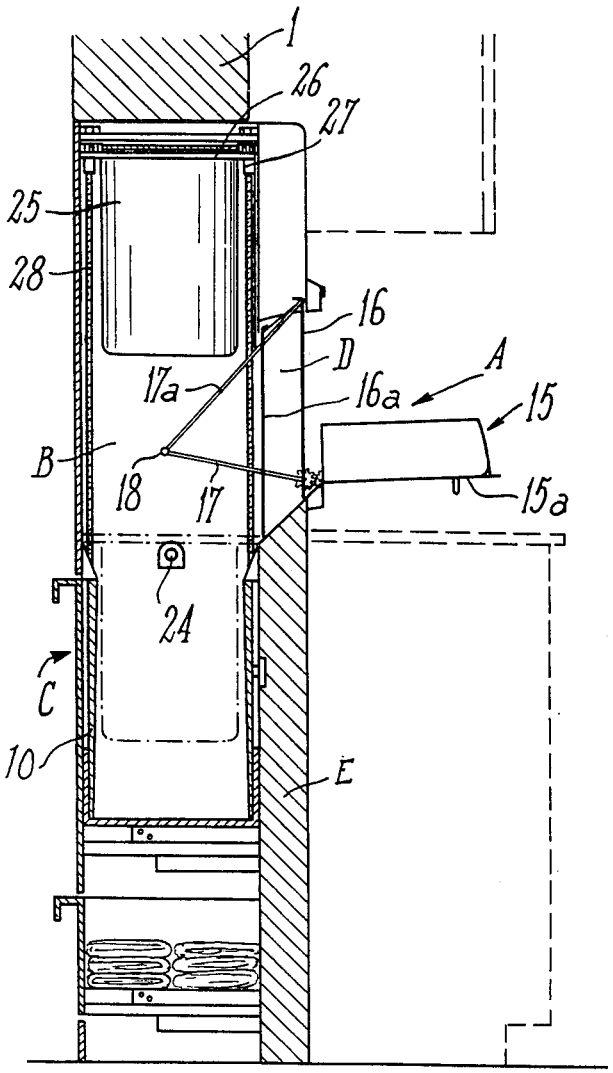
FIG. 3 is a side-elevational and vertical sectional view of a rubbish chute, with a box-shaped trap thereof in its open position.
Figure 4:
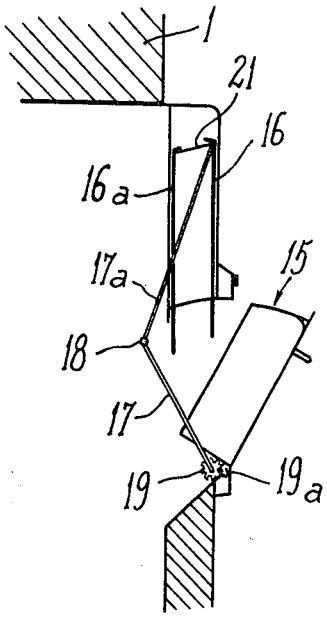
FIGS. 4 and 5 are fragmentary vertical sections showing the box-shaped trap and a double-seal system, the trap being shown in its partly-closed position in FIG. 4 and in its fully closed position in FIG. 5.

When pivoted in a closing direction, the trap 15 will move the curtain 16 to its uppermost position corresponding to the closing of aperture D (FIG. 4), and when trap 15 is pivoted in the opposite direction, the front curtain 16 is moved to its lowermost position corresponding to the opening of aperture D, with the trap ready to receive garbage (FIG. 3).

On the other hand, curtains 16 and **16*a* are operatively interconnected by a mechanism described herein and illustrated in FIGS. 6 to 10**, it being understood however that other means may be contemplated for this purpose, without departing from the basic principles of the invention.

The rear curtain **16*a* has on either side thereof a spring-loaded pawl 20 engageable by a driving member 21 pivoted to a pin 22 rigid with the front curtain 16. The driving member 21 may have any suitable configuration and is adapted to move in a pair of guide members 23 formed with curved or bent portions 23*a***.

This mechanism operates as follows (see FIGS. 8 to 10).

Figure 8:
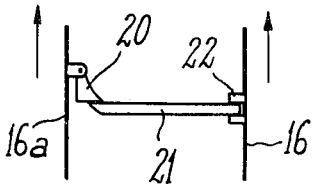
FIGS. 8 to 10 are diagrammatic sections showing the mode of operation of the system.
Figure 6:
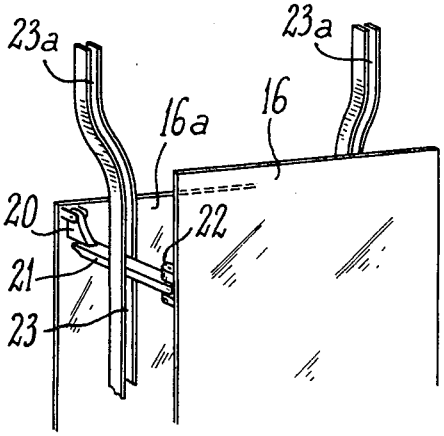
FIG. 6 is a fragmentary perspective view of the double-seal system.

Assuming that the trap 15 is in its open position, with the curtains 16 and **16*a* providing a double seal for the aperture D, as shown in FIG. 8, the driving member 21 engages pawl 20** so that the two curtains are coupled to each other.

Thus, when the front curtain 16 is lifted, it carries along the rear curtain **16*a*** toward the top of the apparatus.

Figure 9:
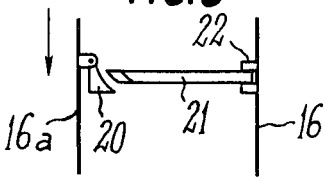
Figure 10:
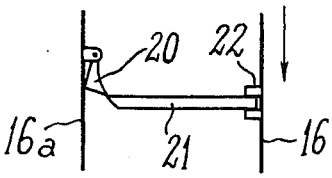
Figure 5:
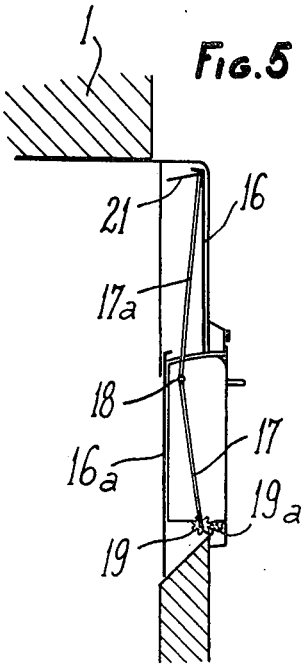

However, when the driving members 21 engage the curved portions **23*a* of guide members 23, they are caused to move away from pawls 20, thus releasing the rear curtain 16*a* which is thus allowed to fall by gravity (FIG. 9). Therefore, the aperture D is closed simultaneously by the bottom 15*a* of trap 15 and rear curtain 16*a* (FIG. 5**).

To avoid a too sudden fall of rear curtain **16*a***, some known means, preferably of the pneumatic or hydraulic cylinder type, may be used for retarding this movement as will readily occur to those conversant with the art.

When the trap 15 is moved to its open position, front curtain 16 moves downwardly, and the driving members 21 re-engage the pawls 20, which are however caused firstly to retract (FIG. 10) before resuming their position of being engaged by the driving members 21 associated with front curtain 16, thereby restoring the mutual coupling of the two curtains.

With the arrangement of this invention, when the box-shaped trap 15 is full, or whenever necessary, the trap 15 is simply pushed back against the wall, this movement causing both curtains 16 and **16*a* to open simultaneously so that the trap contents are discharged through the chute into the assembly C. Then, curtain 16 remains open or in its uppermost position, and the aperture D is closed tightly by the box-shaped trap 15. However, as soon as the contents of trap 15 have been discharged, the curtain 16 is dropped again to close the aperture D. Thus, whether the rubbish chute box-shaped trap 15 is closed or open, the assembly C enclosed in the wall structure and containing the garbage is constantly isolated from the kitchen or other room by two tight members consisting of the pair of curtains 16 and 16*a* when trap 15 is open, or alternatively of curtain 16*a* and the bottom of trap 15** when the latter is closed, this isolation being enhanced by the empty space left between these two closing elements. This arrangement is highly appreciable not only in that it constitutes an efficient barrier against bad smells, but also because a thermal insulation is obtained thereby against cold weather.

All waste, refuse, garbage or rubbish, irrespective of their specific nature discharged from the trap 15 into the rubbish chute, passes compulsorily through the aperture D (formed to this end with an inclined bottom surface) and fall into the underlying collecting receptacle 10 of assembly C. When the receptacle is full, any overflow is detected by a time-lag photocell shown diagrammatically at 24, and the signal thus produced is exploited for energizing the compacting assembly B. The latter comprises a piston 25 vertically movable in assembly B under the control of any suitable and known means such as a horizontal plate 26 rigid with piston 25 and adapted to be lowered by means of internally-threaded sockets 27 engaged by screw-threaded rods 28 disposed for instance at the four corners of plate 26, sockets 27 being rotatably mounted in plate 26 and driven for rotation for example by an endless chain engaging pinions rigid with sockets 27, such chain being driven in turn from a suitable motor (not shown).

It will be apparent that when container 10 of assembly C is filled with compacted refuse, then assembly C may be removed from the chute in a direction exterior of the building, i.e. to the left in FIG. 3.

Althrough a specific embodiment of this invention has been described hereinabove and illustrated in the accompanying drawings, it will readily occur to those skilled in the art that various modifications and changes may be brought thereto without departing from the scope of the invention as set forth in the appended claims.

I claim:

1. A refuse, collecting, compacting and discharge system for use in a building, said system comprising:

a refuse chute positioned within an exterior wall of a building;

a refuse compacting assembly positioned within an upper portion of said refuse chute;

a refuse collecting assembly positioned within a lower portion of said refuse chute;

an insulating partition separating said refuse collecting assembly from the interior of the building, said insulating partition comprising framing defining hollow walls filled with insulating material;

an aperture communicating the interior of the building with said refuse chute at a position above said refuse collecting assembly, said aperture having a lower edge defined by a surface which is inclined inwardly and downwardly in a direction from the interior of the building to said refuse chute; and a box-shaped trap adapted to receive refuse, said trap being hingedly mounted at said lower edge of said aperture such that said trap is pivotably movable between a first position closing said aperture and a second position extending into the interior of the building away from said aperture.

2. A system as claimed in claim 1, further comprising a double closing assembly including first and second spaced parallel curtains, said first curtain being positioned at the interior side of said aperture, said second curtain being positioned at the exterior side of said aperture, said first and second curtains being vertically movable between respective first positions closing said aperture and respective second raised positions opening said aperture.

3. A system as claimed in claim 2, further comprising linkage means, connecting said trap with said first curtain, for raising said first curtain to said second position thereof when said trap is moved to said first position thereof, and for lowering said first curtain to said first position thereof when said trap is moved to said second position thereof.

4. A system as claimed in claim 3, further comprising means for forming interlocking engagement between said first and second curtains during movement of said first curtain toward said second position thereof, such that said second curtain is moved toward said second position thereof during upward movement of said first curtain.

5. A system as claimed in claim 4, further comprising means for releasing said interlocking engagement between said first and second curtains when said second curtain reaches said second position thereof and when said trap reaches said first position thereof, and for thus allowing said second curtain to return by gravity to said first position thereof.

6. A system as claimed in claim 5, wherein said interlocking means comprises pawls on said second curtain and driving members on said first curtain, said driving members being positioned to contact said pawls.

7. A system as claimed in claim 6, wherein said releasing means comprise means for moving said driving members laterally out of contact with said pawls.

8. A system as claimed in claim 1, wherein said refuse collecting assembly includes a bottomless container, and a bag positioned externally of said container, said bag having an upper portion clamped to an upper portion of said container.

9. A system as claimed in claim 8, wherein said container has a base portion having larger internal dimensions than said upper portion of said container.

* * * * *